US008702902B2

(12) United States Patent
Blom et al.

(10) Patent No.: US 8,702,902 B2
(45) Date of Patent: Apr. 22, 2014

(54) DEVICE FOR GENERATING A PLASMA DISCHARGE FOR PATTERNING THE SURFACE OF A SUBSTRATE

(75) Inventors: Paulus Petrus Maria Blom, Veldhoven (NL); Philip Rosing, Eindhoven (NL); Alquin Alphons Elisabeth Stevens, Eindhoven (NL); Laurentia Johanna Huijbregts, Eindhoven (NL); Eddy Bos, Eersel (NL)

(73) Assignee: Vision Dynamics Holding B.V., AC Eindhoven (NL)

( * ) Notice: Subject to any disclaimer, the term of this patent is extended or adjusted under 35 U.S.C. 154(b) by 320 days.

(21) Appl. No.: 13/059,909

(22) PCT Filed: Aug. 20, 2008

(86) PCT No.: PCT/NL2008/050555

§ 371 (c)(1), (2), (4) Date: May 16, 2011

(87) PCT Pub. No.: WO2010/021539

PCT Pub. Date: Feb. 25, 2010

(65) Prior Publication Data

US 2011/0226728 A1 Sep. 22, 2011

(51) Int. Cl.
*C23F 1/00* (2006.01)

(52) U.S. Cl.
USPC ..... 156/345.45; 156/345.44; 156/345.48; 216/71

(58) Field of Classification Search
USPC ..... 156/345.45, 345.47, 345.43, 345.48, 156/345.44, 345.5; 118/723 R, 723 E; 216/58, 67, 71
See application file for complete search history.

(56) References Cited

U.S. PATENT DOCUMENTS 4,711,627 A 12/1987 Oeschsle et al.
4,718,340 A 1/1988 Love, III
(Continued)

FOREIGN PATENT DOCUMENTS

DE 10322696 B3 1/2005
FR 1041217 A 10/1953
(Continued)

OTHER PUBLICATIONS

International Search Report dated Oct. 9, 2009, for International Application No. PCT/NL2008/050555.
(Continued)

*Primary Examiner* — Lan Vinh
(74) *Attorney, Agent, or Firm* — Knobbe, Martens, Olson & Bear, LLP

(57) ABSTRACT

Device for generating a plasma discharge for patterning the surface of a substrate, comprising a first electrode having a first discharge portion and a second electrode having a second discharge portion, a high voltage source for generating a high voltage difference between the first and the second electrode, and positioning means for positioning the first electrode with respect to the substrate, wherein the positioning means are arranged for selectively positioning the first electrode with respect to the second electrode in a first position in which a distance between the first discharge portion and the second discharge portion is sufficiently small to support the plasma discharge at the high voltage difference, and in a second position in which the distance between the first discharge portion and the second discharge portion is sufficiently large to prevent plasma discharge at the high voltage difference.

27 Claims, 6 Drawing Sheets

(56) References Cited

U.S. PATENT DOCUMENTS

| | | | | |
|---|---|---|---|---|
| 4,911,075 | A | 3/1990 | Lewis et al. | |
| 5,062,364 | A | 11/1991 | Lewis et al. | |
| 5,084,125 | A * | 1/1992 | Aoi | 156/345.31 |
| 5,237,923 | A | 8/1993 | Williams et al. | |
| 5,399,254 | A * | 3/1995 | Geisler et al. | 204/298.31 |
| 6,028,615 | A | 2/2000 | Pletcher et al. | |
| 6,109,717 | A | 8/2000 | Kane et al. | |
| 6,629,757 | B1 * | 10/2003 | Sugioka et al. | 347/71 |
| 2004/0129220 | A1 | 7/2004 | Saitoh et al. | |
| 2005/0241582 | A1 * | 11/2005 | Dobbyn et al. | 118/723 E |
| 2006/0024504 | A1 | 2/2006 | Nelson et al. | |
| 2006/0144517 | A1 * | 7/2006 | Nakamura | 156/345.36 |
| 2006/0240648 | A1 | 10/2006 | Mikhael et al. | |
| 2007/0069401 | A1 | 3/2007 | Kakehata | |
| 2007/0210036 | A1 | 9/2007 | Uno et al. | |
| 2008/0029485 | A1 | 2/2008 | Kelley et al. | |
| 2008/0083710 | A1 | 4/2008 | Chen et al. | |
| 2008/0278540 | A1 | 11/2008 | Lin et al. | |

FOREIGN PATENT DOCUMENTS

| | | | |
|---|---|---|---|
| GB | 1480081 | A | 7/1977 |
| JP | S58110674 | A | 7/1983 |
| JP | S61204740 | U | 12/1986 |
| JP | H04089261 | A | 3/1992 |
| JP | 2003229299 | A | 8/2003 |
| JP | 2004111948 | A | 4/2004 |
| JP | 2004111381 | A | 8/2004 |
| JP | 2004220935 | A | 8/2004 |
| JP | 2008084694 | A | 4/2008 |
| JP | 2009043673 | A | 2/2009 |
| WO | 9205957 | A1 | 4/1992 |
| WO | 9212011 | A1 | 7/1992 |
| WO | 9214618 | A1 | 9/1992 |
| WO | 0079843 | A1 | 12/2000 |
| WO | 0236851 | A1 | 5/2002 |
| WO | 02061787 | A2 | 8/2002 |
| WO | 02087295 | A1 | 10/2002 |
| WO | 2006087558 | A2 | 8/2006 |
| WO | 2007104512 | A1 | 9/2007 |
| WO | 2008004858 | A1 | 1/2008 |

OTHER PUBLICATIONS

M. Charbonnier, et al, Surface plasma functionalization of polycarbonate: Application to electroless nickel and copper plating:. Journal of applied Electrochemistry 31: 57-63, 2001.

S. Kreitz, et al, "Patterned DBD treatment for are-selective metallization of polymers-plasma printing", Surface & Coatings Technology 200 (2005) 676-679.

* cited by examiner

1

1

DEVICE FOR GENERATING A PLASMA DISCHARGE FOR PATTERNING THE SURFACE OF A SUBSTRATE

This application is U.S. National Phase of International Application No. PCT/NL2008/050555, filed Aug. 20, 2008, designating the United States, and published as WO 2010/021539 on Feb. 25, 2010.

The invention relates to a device for generating a plasma discharge for patterning the surface of a substrate, especially to such device comprising a first electrode having a first discharge portion and a second electrode having a second discharge portion, a high voltage source for generating a high voltage difference between the first and the second electrode, and positioning means for positioning the first electrode with respect to the substrate.

BACKGROUND OF THE INVENTION

It is well-known that plasma's can be used to treat a surface; with the use of a plasma, it is possible to etch, to deposit a material onto a substrate, and/or to change a property of a surface of a substrate, e.g. changing it from hydrophobic to hydrophilic and chemical attachment of atoms. The latter can for example be used in the process of metalizing a plastic substrate (see for example M. Charbonnier et al. in Journal of Applied Electrochemistry 31, 57 (2001)). In this process, a plasma makes the surface of a plastic suitable for attachment of Palladium, on which a metal layer can be grown. Compared to many other metalizing methods, this method has the advantage that the temperature can remain low, which is necessary for plastics having low melting points. For the production of plastic electronics like RFID tags and OLEDs, plasma treatment may thus be useful.

For these applications, making patterned structures directly with the plasma on the surface reduces the number of steps for the fabrication of the electronics. Further, compared to traditional mask/etch methods, there is no waste of metal (due to deposition and subsequent etching of the metal layer), reducing environmental burden. Also for other applications, like labs on chips, direct patterning with a plasma would be useful.

Known devices for directly patterning a surface with a plasma are described in DE 10322696 and in Surface & Coatings Technology 200, 676 (2005). These devices use a mask for generating the pattern. This may be a good method for mass production, but, as making a mask is quite expensive and takes time, a maskless method would be preferable for production of smaller amounts.

Another device for directly patterning a surface with a plasma is known from U.S. Pat. No. 4,911,075. This device utilizes a precisely positioned high voltage spark discharge electrode to create on the surface of a substrate an intense-heat spark zone as well as a corona zone in a circular region surrounding the spark zone. The discharge electrode is scanned across the surface while high voltage pulses having precisely controlled voltage and current profiles to produce precisely positioned and defined spark/corona discharges in register with a digital image. Although not using a physical mask, this device has the disadvantage that complicated precise control of the high voltage pulses is required. Further, since the device uses a counter electrode behind the substrate, only thin substrates may be used. Also, spark discharge may not be desirable for certain processes of deposition, etching and hydrophilation.

SUMMARY OF THE INVENTION

It is an object of the invention to provide a device for generating a plasma discharge, suitable for maskless direct patterning of a substrate. The device should preferably have simple control, long electrode life, be able to quickly pattern the substrate and/or be suitable for a large range of substrates, e.g. thick and thin substrates.

More in general, it is an object of the invention to provide an improved device for generating a plasma discharge for patterning the surface of a substrate, comprising a first electrode having a first discharge portion and a second electrode having a second discharge portion, a high voltage source for generating a high voltage difference between the first and the second electrode and, preferably, positioning means for positioning the first electrode with respect to the substrate.

According to a first aspect of the invention the positioning means are arranged for selectively positioning the first electrode with respect to the second electrode in a first position in which a distance between the first discharge portion and the second discharge portion is sufficiently small to support the plasma discharge at the high voltage difference, and in a second position in which the distance between the first discharge portion and the second discharge portion is sufficiently large to prevent plasma discharge at the high voltage difference. Preferably, the positioning means are arranged for moving the first electrode in a direction towards and away from the second electrode.

This provides the advantage that the plasma can be switched on or off by placing the first electrode in the first or second position respectively using the positioning means. Hence, no control of the high voltage supply to the electrodes is necessary.

In an embodiment, the second electrode is designed as a drum on the outer surface of which a sheet-shaped substrate can be placed in between the drum and the first electrode, while the positioning means are arranged for moving the first electrode in a direction normal to the outer surface. Hence, sheet-shaped electrically insulating substrates, such as plastic foil, may be patterned.

In another embodiment, the positioning means are further arranged for positioning the second electrode in synchronism with the first electrode. This provides the advantage that the first and second electrode together, e.g. as a writing head, can be scanned along the surface of the substrate, hence scanning the plasma along the surface. Moreover, the first and second electrode being scanned in synchronism, e.g. side-by-side, provides the advantage that no electrode is required behind the substrate, so that also non-sheet-shaped substrates, such as thick substrates, irregularly shaped substrates and/or three-dimensional substrates can be scanned.

Preferably, the positioning means are further arranged for positioning the first electrode along the surface of the substrate. Thus, in addition to switching the plasma on or off, the positioning means can also be used to scan the first electrode, and hence the plasma, along the surface of the substrate. It will be appreciated that the positioning means may comprise separate actuators, e.g. a first actuator for moving the first electrode in a direction towards and away from the second electrode, a second actuator to move the first electrode in a first direction along the surface of the substrate and a third actuator to move the first electrode in a second direction along the surface of the substrate.

Preferably, the device further comprising a housing, wherein the first electrode is at least partially surrounded by the housing, and the first electrode is movable with respect to the housing. The housing may be electrically insulating. Thus, the first electrode may be protected by the housing. It is for instance possible that the first electrode is substantially fully retracted within the housing when in the second position and partly protrudes from the housing when in the first position. Thus, the first electrode may be protected from dirt, debris or reaction products of the plasma.

Preferably the high voltage source is arranged for adjusting the high voltage difference between the first and the second electrode. Hence, it is possible to adjust e.g. the spatial extent of the plasma when ignited. Thus, a "dot size" may be adjusted of an area of the substrate affected by the plasma when on. Thus, the dot size of "printing" the pattern on the substrate using the plasma may be determined.

In an embodiment, the device comprises a plurality of first electrodes. These first electrodes may e.g. be placed side-by side in a print head, so as to be positioned along the surface of the substrate simultaneously.

Preferably, the positioning means are arranged for individually positioning each first electrode with respect to the second electrode. Thus, each first electrode of the plurality of first electrodes may be individually positioned to ignite or extinguish the plasma.

It is also possible that the device comprises a plurality of second electrodes. Preferably, the positioning means are arranged for individually positioning each first electrode with respect to one or more second electrodes.

In a special embodiment, the first electrode is formed by a movable pen of a print head of a matrix printer, electrically conducting connected to the high voltage source.

According to a second aspect of the invention, the positioning means are further arranged for positioning the second electrode in synchronism with the first electrode, wherein the positioning means are not necessarily arranged for positioning the first electrode with respect to the second electrode. This also provides the advantage that the first and second electrode together, e.g. as a writing head, can be scanned along the surface of the substrate, hence scanning the plasma along the surface. Moreover, the first and second electrode being scanned in synchronism, e.g. side-by-side, provides the advantage that no electrode is required behind the substrate, so that also thick substrates, irregularly shaped substrates and/or three-dimensional substrates can be scanned.

According to a third aspect of the invention, the device for generating a plasma discharge for patterning the surface of a substrate comprises a plurality of first electrodes and a plurality of second electrodes, a high voltage source arranged for generating a high voltage difference between selected first electrodes of the plurality of first electrodes and selected second electrodes of the plurality of second electrodes. Herein the device does not necessarily comprise positioning means for positioning the first and/or second electrodes. Thus, the plurality of first electrodes and the plurality of second electrodes may treat a selected portion of the surface of the substrate by providing the high voltage difference between the associated first and second electrodes. The device may treat the entire selected portion at once, or by applying the high voltage difference to selected first and second electrodes consecutively. Preferably, the first and second electrodes are positioned side-by-side. Preferably the first and second electrodes are interspersed. Optionally, the first and second electrodes are, at least near the substrate, entirely comprised in an electrically insulating, e.g. ceramic, house.

The invention also relates to a method for patterning the surface of a substrate using a plasma discharge, comprising providing a first electrode having a first discharge portion and a second electrode having a second discharge portion, generating a high voltage difference between the first and the second electrode, and selectively generating the plasma discharge by positioning the first electrode with respect to the second electrode in a first position in which a distance between the first discharge portion and the second discharge portion is sufficiently small to support the plasma discharge at the high voltage difference, and selectively extinguishing the plasma discharge by positioning the first electrode with respect to the second electrode in a second position in which the distance between the first discharge portion and the second discharge portion is sufficiently large to prevent plasma discharge at the high voltage difference.

The method preferably further comprises selectively etching the surface by means of the plasma discharge, selectively depositing a material onto the surface by means of the plasma discharge, and/or selectively change a property of the surface, e.g. changing it from hydrophobic to hydrophilic, by means of the plasma discharge.

The device according to the invention may be used for treating the surface of an electrically insulating substrate, such as a plastic object, e.g. a sheet of plastic. The device according to the invention may also be used for treating the surface of a semiconducting or conducting substrates. When using the (semi-)conducting substrate, the first and/or second electrodes are preferably covered, e.g. coated, with electrically insulating material as described above. It will be appreciated that the electrically conducting substrate may also be used as the second electrode.

It has been found that the device according to the invention is suitable for use in treating the surface of various substrates. The invention also relates to a method for manufacturing a meso-scale electronics device (such as an (O)LED device, an RFID tag, or a solar-cell device), a meso-scale three dimensional structure (such as a MEMS device, a micro-lens or a multi-focus lens), a lab-on-chip, a biochip, a printable plastics object or an offset printing plate from a substrate, comprising treating the substrate with a device for generating a plasma discharge according to the invention.

The invention further relates to a method of manufacturing a device for generating a plasma discharge according to the invention, comprising providing a conventional matrix printer, providing a high voltage source for generating a high voltage difference, electrically conducting connecting at least one printing pen of the print head of the matrix printer with the high voltage source, and optionally electrically conducting connecting the surface of a print drum of the matrix printer with the high voltage source. Hence, the at least one printing pen forms an electrode for generating the plasma.

BRIEF DESCRIPTION OF THE DRAWING

The invention will be described by, non-limiting, examples in reference to the accompanying drawing, wherein.

DETAILED DESCRIPTION

Figure 1:
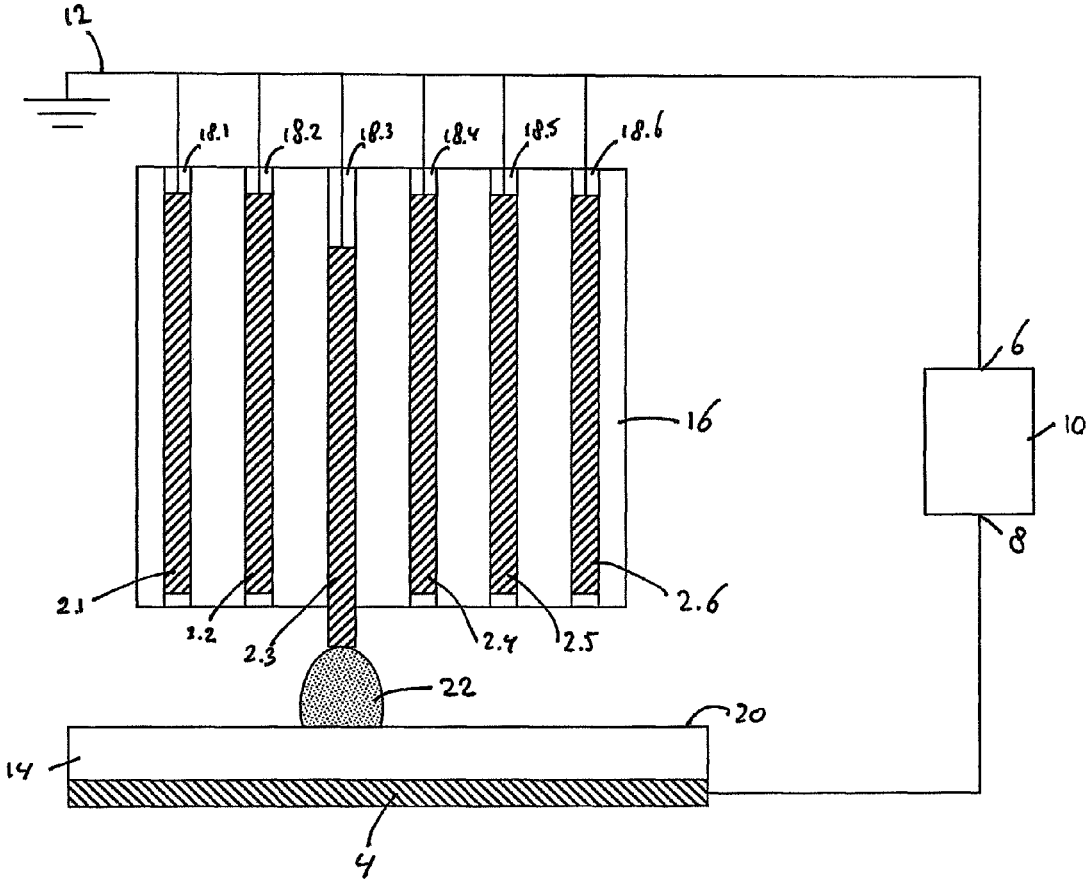
FIG. 1 shows a schematic representation of a first embodiment of a device according to the invention.

FIG. 1 shows a schematic representation of a first embodiment of a device 1 for generating a plasma discharge for patterning the surface of a substrate according to the invention.

In this example, the device 1 comprises a plurality of first electrodes 2.*i* (i=1, 2, 3, . . . ). In this example, the first electrodes 2.*i* are designed as elongate pens. The device 1 further comprises a second electrode 4. In this example, the second electrode is plate-shaped. The first and second electrodes 2.*i*, 4 are electrically conducting connected to terminals 6,8 of a high voltage source 10 respectively. The high voltage source 10 is arranged for generating a high voltage difference between the first electrodes 2.*i* and the second electrode 4. In this example, the first electrodes 2.*i* are also connected to ground at 12. It will be appreciated that the first electrodes may be negatively charged with respect to the second electrode or vice versa, e.g. depending on whether ions or electrons are desired to impact onto the substrate. In this example, the high voltage difference comprises a DC voltage difference. Alternatively, or additionally, the high voltage difference may comprise an AC voltage difference (e.g. radiofrequent (RF)), pulsed voltage difference, etc.

In this example a substrate 14 to be treated is positioned in between the first electrodes 2.*i* and the second electrode 4, in this example on top of the second electrode 4. The second electrode 4 of this example is also referred to as counter electrode.

In FIG. 1 the device 1 further comprises a housing 16. The housing 16 comprises a plurality of bores 18.*i* in each of which one first electrode 2.*i* is housed. Each first electrode 2.*i* is slidably housed in its respective bore 18.*i*. In this example, the device 1 comprises positioning means arranged for individually moving each one of the first electrodes 2.*i* in its respective bore 18.*i*. The positioning means may comprise an electric motor, such as a linear motor, a rack and pinion, a piezoelectric actuator, an electromagnetic solenoid or the like.

The device 1 as discussed thus far may be operated in the following manner.

First the substrate 14 is placed between the second electrode 4 and the first electrodes 2.*i*. The high voltage difference is set and maintained between the first and second electrodes.

When the surface 20 of the substrate 14 is to be selectively treated with a plasma, the location where the surface 20 is to be treated is determined. The first electrode 2.*i* closest to the determined location on the surface is selected. In this example, first electrode 2.3 is selected.

Initially all first electrodes 2.*i* may be in a retracted position, as shown for first electrodes 2.1, 2.2, 2.4, 2.5, and 2.6 in FIG. 1. In this retracted position, the distance between the tip (discharge portion) of the first electrode 2.*i* and the second electrode 4 is sufficiently large to prevent plasma discharge at the high voltage difference. That is, the electric field strength between the first electrode 2.*i* in the retracted position and the second electrode 4 is sufficiently low to prevent electrical breakthrough.

The positioning means move the selected first electrode 2.3 towards the second electrode 4 into an extended position (see FIG. 1). In this extended position, the distance between the tip (discharge portion) of the selected first electrode 2.3 and the second electrode 4 is sufficiently small to support the plasma discharge at the high voltage difference. That is, the electric field strength between the first electrode in the extended position and the second electrode 4 is sufficiently low to support the onset of a plasma discharge. In FIG. 1 the plasma is indicated at 22.

Since the electric field between the first and second electrodes passes through the substrate, the device according to FIG. 1 is suitable for sheet-shaped substrates, such as plastics foils.

The fact that the first electrodes can be retracted provides the advantage that there may be less erosion of the first electrodes adjacent to the first electrode that generates the plasma, because the plasma will not reach the retracted first electrodes. This effect will be improved by completely retracting the first electrodes into the housing (as shown in FIG. 1), especially if the housing 16 comprises an electrically insulating bottom near the plasma. This also applies to the first and second electrodes of the devices shown in FIGS. 2 and 3. It will be appreciated, however, that it is not strictly necessary that the electrodes are enclosed by the housing 16. The housing may also comprise a substantially open structure for guiding the electrodes.

By steering the distance between a first electrode and the second electrode, the intensity of the plasma can be steered.

Since the distance between the first electrodes and the surface of the substrate can be controlled, the treatment of curved surfaces and/or 3-dimensional objects may be feasible (possibly in combination with a second electrode that is not flat but follows the shape of the substrate).

Figure 2:
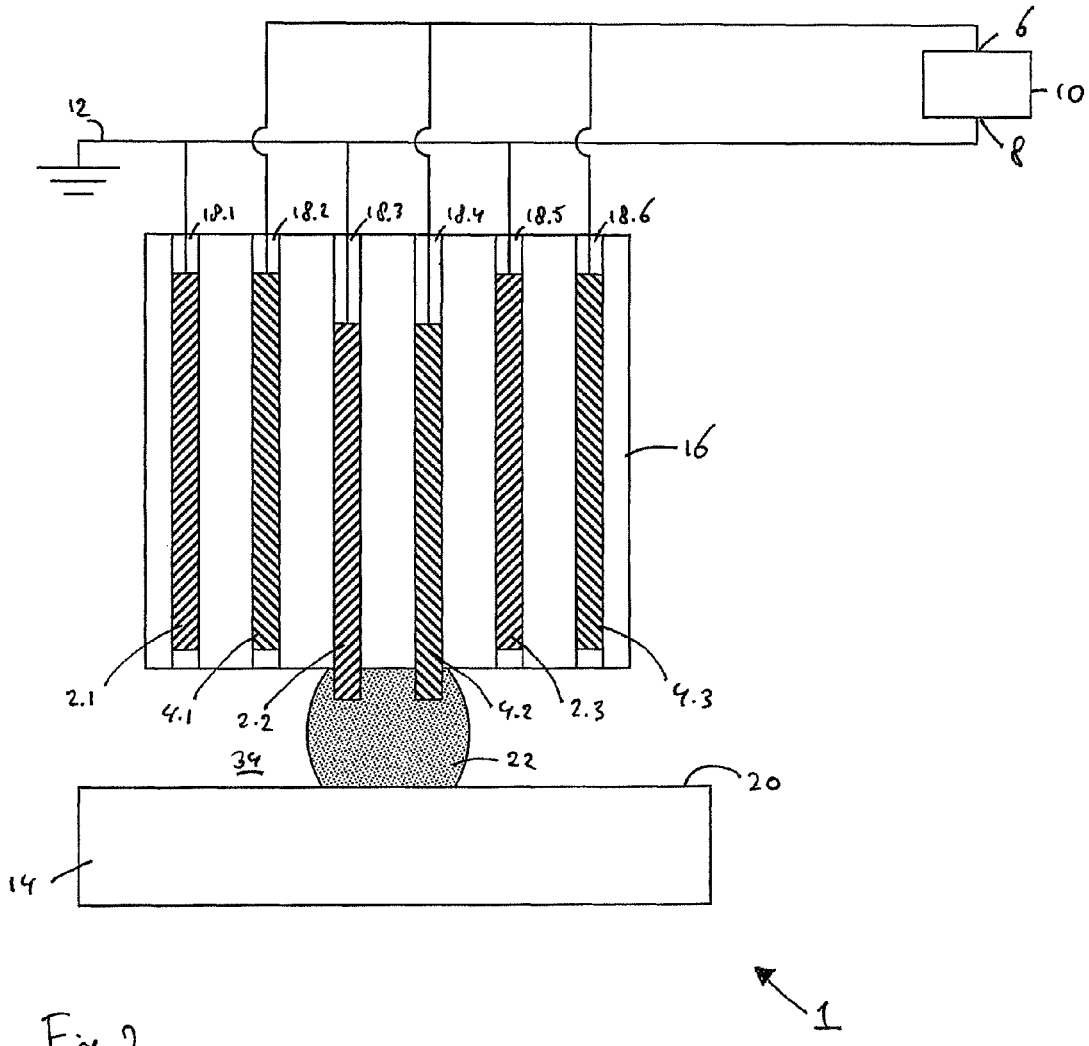
FIG. 2 shows a schematic representation of a second embodiment of a device according to the invention.

FIG. 2 shows a schematic representation of a second embodiment of a device 1 according to the invention. In this example, the plurality of first electrodes 2.*i* and a plurality of second electrodes 4.*j* (j=1, 2, 3, . . . ) are positioned side-by-side. In this example both the first and second electrodes are slidably housed in their respective bores 18.*k* (k=1, 2, 3, . . . ).

The device 1 as shown in FIG. 2 may be operated in the following manner.

The substrate 14 is placed near the first and second electrodes, 2.*i*, 4.*j*. The high voltage difference is set and maintained between the first and second electrodes.

When the surface 20 of the substrate 14 is to be selectively treated with a plasma, the location where the surface 20 is to be treated is determined. The first electrode 2.*i* and the second electrode 4.*j* closest to the determined location on the surface are selected. In this example, first electrode 2.2 and second electrode 4.2 are selected.

Initially all first electrodes 2.*i* and all second electrodes 4.*j* may be in a retracted position, as shown for electrodes 2.1, 2.3, 4.1, and 4.3 in FIG. 2. In this retracted position, the distance between the tip (discharge portion) of the first electrode 2.*i* and the tip (discharge portion) of the second electrode 4.*j* is sufficiently large to prevent plasma discharge at the high voltage difference. That is, the electric field strength between the first electrode 2.*i* in the retracted position and the second electrode 4.*j* in the retracted position is sufficiently low to prevent electrical breakthrough.

The positioning means move the selected first electrode 2.2 and the selected second electrode 4.2 towards the extended position (see FIG. 2). In this extended position, the distance between the tip of the selected first electrode 2.2 and the tip of the selected second electrode 4.2 is sufficiently small to support the plasma discharge at the high voltage difference. That is, the electric field strength between the first electrode in the extended position and the second electrode in the extended position is sufficiently low to support the onset of a plasma discharge.

Since in the example of FIG. 2 both the first and the second electrode are positioned at the same side of the substrate 14, also non-sheet-shaped substrates, such as thick substrates, irregularly shaped substrates and/or three-dimensional substrates can be treated with the plasma 22.

As will be described in more detail hereinbelow, the positioning means may be further arranged for positioning the first electrode 2.*i* along the surface of the substrate. Thus, the housing 16 comprising the electrodes as shown in FIG. 1 and FIG. 2 may be scanned along the surface 20 of the substrate 14. Hence, it is possible to selectively expose areas of the surface 20 to the plasma 22. Herein, the housing 16 comprising the electrodes may be understood to function as a "print head" for plasma treatment instead of ink deposition.

Figure 3:
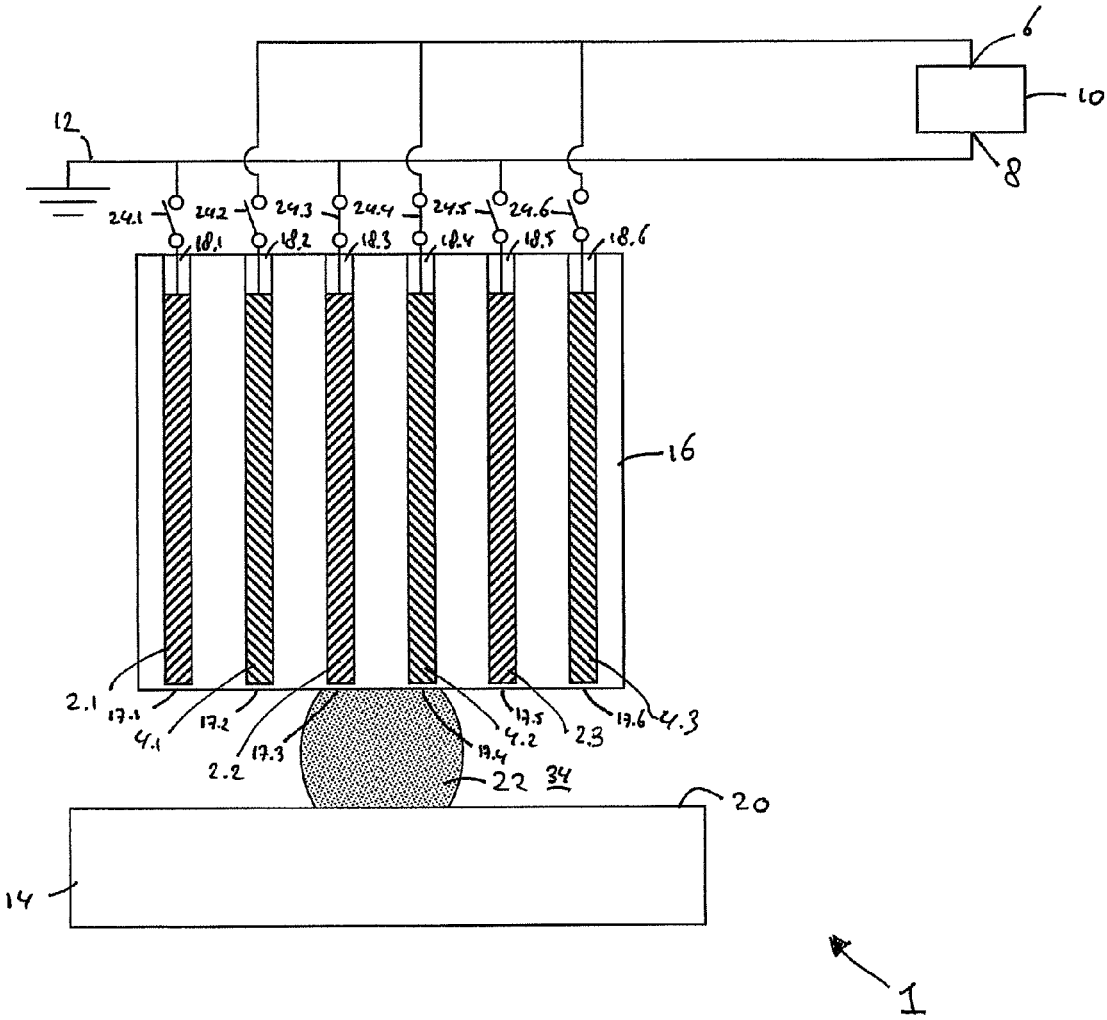
FIG. 3 shows a schematic representation of a third embodiment of a device according to the invention.

FIG. 3 shows a schematic representation of an embodiment of a device 1 according to a second aspect of the invention. The device shown in FIG. 3 is highly similar to the device shown in FIG. 2. One difference is that in the device 1 shown in FIG. 2, the electrodes 2.*i* and 4.*j* are connected to the high voltage source 10 via respective switches 24.*k* (k=1, 2, 3, . . . ). The device 1 as shown in FIG. 3 may be operated in the following manner.

The substrate 14 is placed near the first and second electrodes, 2.*i*, 4.*j*. The high voltage difference is set.

When the surface 20 of the substrate 14 is to be selectively treated with a plasma, the location where the surface 20 is to be treated is determined. The first electrode 2.*i* and the second electrode 4.*j* closest to the determined location on the surface are selected. In this example, first electrode 2.2 and second electrode 4.2 are selected.

Initially all first electrodes 2.*i* and all second electrodes 4.*j* may be disconnected from the high voltage source 10, so that no plasma discharge is generated. The selected first electrode 2.2 and the selected second electrode 4.2 are connected to the high voltage source 10 via switches 24.3 and 24.4, respectively. The distance between the tip of the selected first electrode 2.2 and the tip of the selected second electrode 4.2 is chosen to be sufficiently small to support the plasma discharge at the high voltage difference. That is, the electric field strength between the first electrode and the second electrode is sufficiently low to support the onset of a plasma discharge.

The switches 24.*k* may form part of the high voltage source 10. Hence, the high voltage source 10 is arranged to in a first mode selectively generate the high voltage difference at the electrodes 2.*i* and 4.*j* to support the plasma discharge, and in a second mode generate a decreased voltage difference or zero voltage difference at the electrodes 2.*i*, 4.*j* to prevent plasma discharge.

Since in the example of FIG. 3 both the first and the second electrode are positioned at the same side of the substrate 14, also non-sheet-shaped substrates, such as thick substrates, irregularly shaped substrates and/or three-dimensional substrates can be treated with the plasma 22.

In the example of FIG. 3 both the first and second electrodes are selectively connected to the high voltage source. It will be appreciated that also some of the electrodes may be permanently connected to the high voltage source, e.g. all first electrodes 2.*i* or all second electrodes 4.*j*.

It will be appreciated that the housing 16 the electrodes of the device 101 shown in FIG. 3 may be scanned along the surface 20 of the substrate 14 as described with respect to FIGS. 1 and 2.

In the example of FIG. 3 the housing 16 is provided with electrical insulations 17.*k* forming a barrier between the electrodes 2.*i*, 4.*j* and a discharge space 34. The electrical insulations 17.*k* prevent the electrodes 2.*i*, 4.*j* to come in direct contact with the plasma 22. Hence, the electrodes are efficiently protected against erosion. The electrical insulations 17.*k* are designed such that the high voltage difference between the electrodes is sufficient to allow the plasma discharge. It will be appreciated that the electrical insulations 17.*k* may also be applied in the device 1 as described with respect to FIG. 1, 2, 4*a*, 4*b* or 5. The electrical insulations may be part of the housing or be a separate covering, e.g. coating, of the electrodes.

For all of the devices shown in FIGS. 1-3, the housing comprising the electrodes may be movable along the substrate 14 like a print head.

Figure 4A:
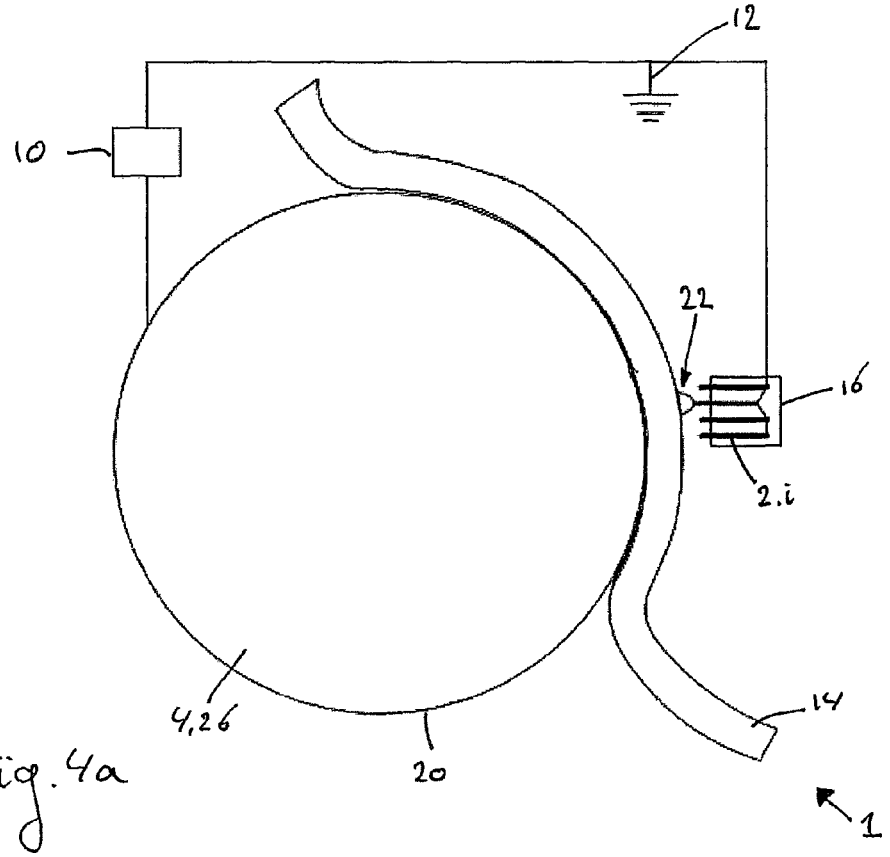
FIGS. 4*a* and 4*b* show a schematic representation of a fourth embodiment of a device according to the invention.
Figure 4B:
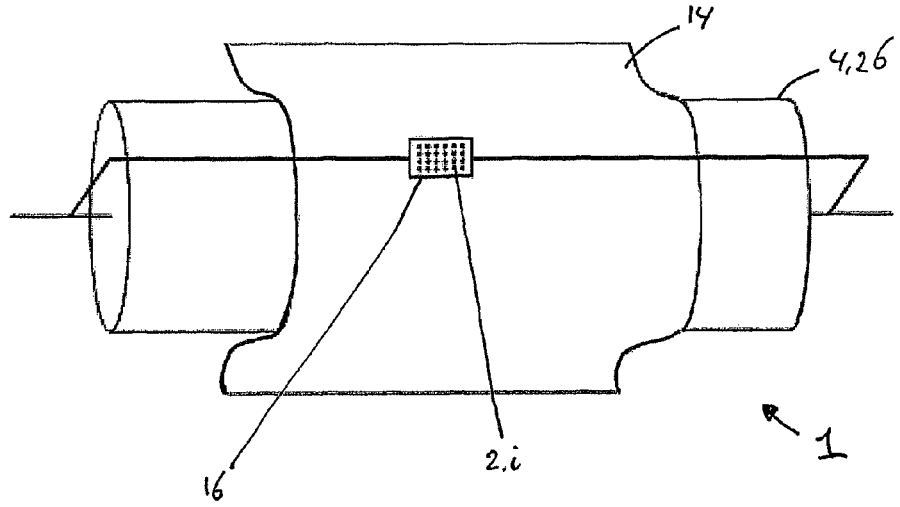

In the example of FIG. 4*a*, the second electrode 4 is designed as a drum 26 on the outer surface 20 of which a sheet-shaped substrate 14 can be placed in between the drum 26 and the first electrodes 2.*i*. In this example, the housing 16 comprising the electrodes is designed as described with respect to FIG. 1. The substrate 14 is transported by the drum shaped second electrode 4, while the housing 16 with the movable first electrodes 2.*i* can move in the direction perpendicular to the cross-section shown in FIG. 4*a*. FIG. 4*b* shows a front view of the device 1 according to FIG. 4*a*. Note that in FIG. 4*b* the housing 16 is shown as comprising a two-dimensional array of first electrodes 2.*i*. It will be appreciated that the housing 16 may also comprise a one-dimensional array of first electrodes 2.*i* or even a single first electrode 2.

Figure 5:
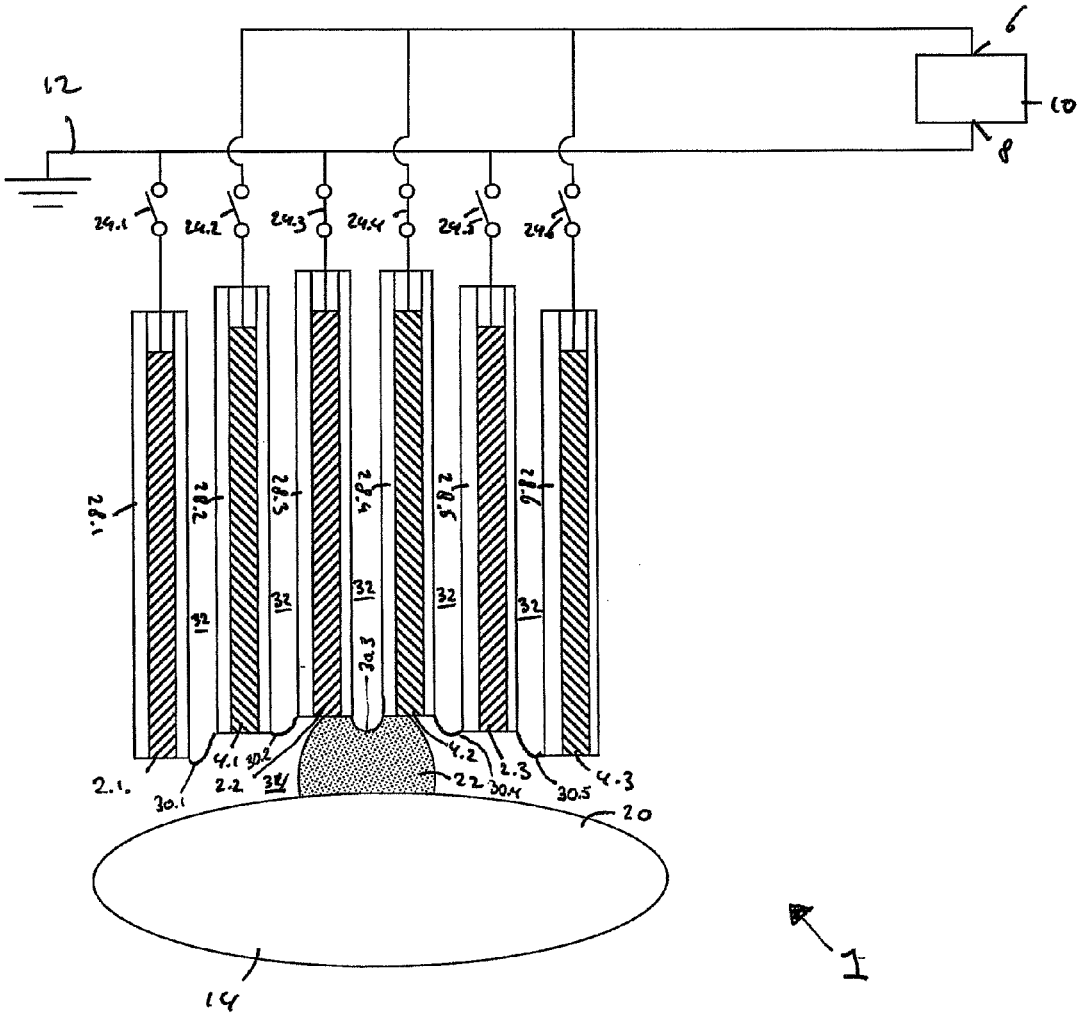
FIG. 5 shows a schematic representation of a fifth embodiment of a device according to the invention.

FIG. 5 shows a further embodiment of a device 1 for generating a plasma discharge, suitable for maskless direct patterning of a substrate 14 according to the invention. In this example, the device 201 is specially adapted for patterning the surface 20 of a three-dimensional substrate 14.

In this example, the electrodes 2.*i*, 4.*j* are individually movable in a direction towards and away from the substrate 14, as described with respect to FIGS. 1 and 2. In this example, each electrode 2.*i*, 4.*j* is provided with an electrical insulation 28.*k* mounted fixed with respect to that electrode. Hence, the electrodes 2.*i*, 4.*j* are well protected against erosion.

The device 1 as shown in FIG. 5 may be operated in the following manner.

The substrate 14 is placed near the first and second electrodes, 2.*i*, 4.*j*. All electrodes 2.*i*, 4.*j* are positioned towards the substrate 14 until each electrode touches the surface 20 of the substrate 14. Next all electrodes 2.*i*, 4.*j* are moved away from the surface 20 over a predetermined distance, suitable for generating the plasma 22 for treating the surface 20. Now the electrodes "follow" the contour of the surface 20. Although FIG. 5 shows a one-dimensional array of electrodes, a two-dimensional array of electrodes 2.*i*, 4.*j* is preferred to allow treatment of a surface area of the surface 20 of a three-dimensional substrate.

The high voltage difference is set. When the surface 20 of the substrate 14 is to be selectively treated with a plasma, the location where the surface 20 is to be treated is determined. The first electrode 2.*i* and the second electrode 4.*j* closest to the determined location on the surface are selected. In this example, first electrode 2.2 and second electrode 4.2 are selected.

Initially all first electrodes 2.*i* and all second electrodes 4.*j* may be disconnected from the high voltage source 10, so that no plasma discharge is generated. The selected first electrode 2.2 and the selected second electrode 4.2 are connected to the high voltage source 10 via switches 24.3 and 24.4, respectively.

In the example of FIG. 5, shields 30.*m* (m=1, 2, 3, . . . ) are mounted in between the electrodes 2.*i*, 4.*j*. In this example, the shields are formed by (electrically insulating) foils. The shields 30.*m* prevent the plasma 22 from entering in an open space 32 between the electrodes 2.*i*, 4.*j*. The shields 30.*m* also allow a carrier gas to be entered into the discharge space 34, while preventing the gas from entering the open space 32 between the electrodes. It will be appreciated that the carrier gas in the discharge space 34 can be chosen to promote plasma discharge. The carrier gas may e.g. comprise Argon or Helium. The carrier gas not being present in the open space 32 may cause the high voltage difference to be unable to cause the plasma discharge in the open space 32. It will be appreciated that these shields 30.*m* are optional, and may, if desired, also be applied in the device according FIGS. 1, 2, 3, 4*a* and 4*b*.

The inventors realized that a commercially available matrix printer can easily be converted to a plasma printer comprising a device according to FIG. 1, 2, 3 or 5. The device shown in FIGS. 4*a* and 4*b* could in fact be part of such converted matrix printer.

Converting a conventional matrix printer could be performed as follows.

First, a conventional matrix printer is provided, and a high voltage source for generating a high voltage difference is provided. At least one printing pen of the print head of the matrix printer is electrically conducting connected with the high voltage source.

If a device according to FIG. 1 is desired, the outer surface of the print drum of the conventional matrix printer is electrically conducting connected with the high voltage source. If required, the surface of the print drum may be provided with an electrically conducting coating.

If a device according to FIG. 2, 3 or 5 is desired, at least one printing pen of the print head is connected to the positive terminal of the high voltage source, while at least one other printing pen of the print head is connected to the negative terminal of the high voltage source.

When more than two first electrodes 2.*i* and/or second electrodes 4.*j* are used, they can be arranged in a 1- or 2-dimensional array. A smart way to separate the electrodes in such an array from each other is with a membrane as described in patent WO 2008/004858, incorporated herein by reference. In this way, the electrodes 2.*i*, 4.*j* can be placed close together, e.g. in a hexagonal packing, with a membrane separating individual electrodes. When the membrane is electrically insulating, the electrodes are electrically isolated from each other as well. Another advantage of the arrangement and method of pin movement described in WO 2008/004858 is that the electrodes can be moved individually without influencing each other.

Figure 6:
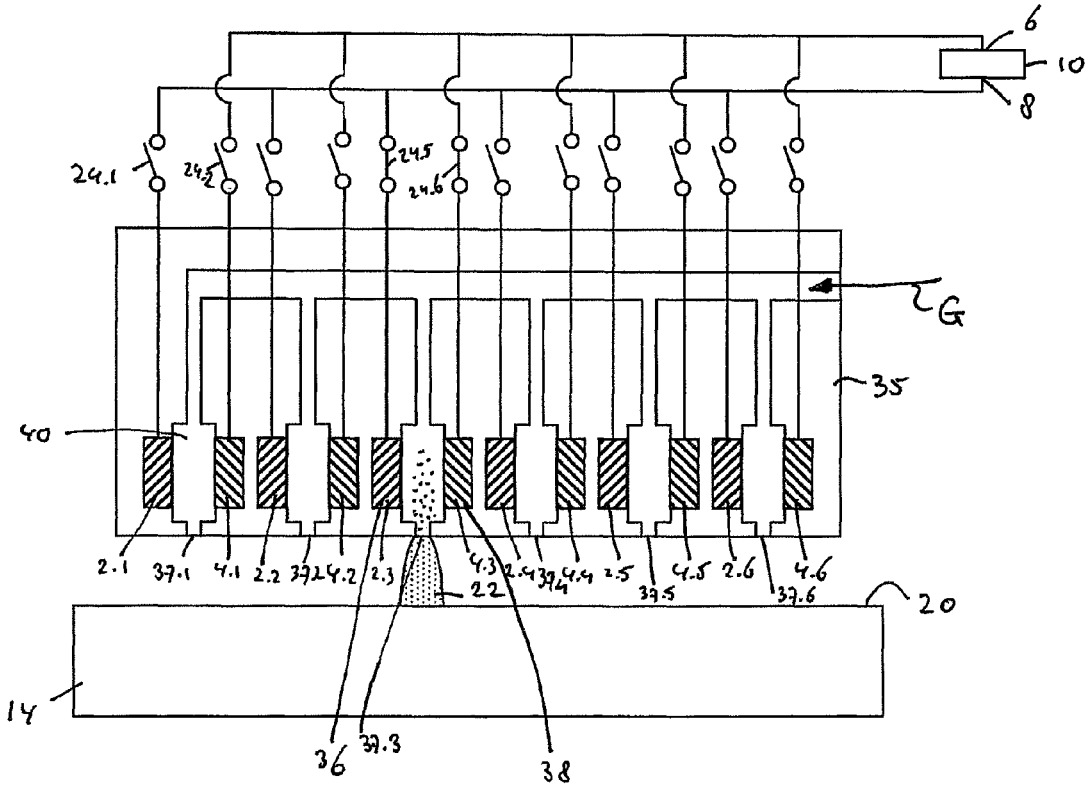
FIG. 6 shows a schematic representation of a sixth embodiment of a device according to the invention.

FIG. 6 shows a sixth embodiment of a device 1 according to the invention. In this embodiment a conventional inkjet print head 35 is converted for the purpose of providing the plasma discharge. In this example, the inkjet print head comprises a plurality of nozzles 37.*n* (n=1, 2, 3, . . . ). Per nozzle, two piezo-electric elements 36,38 are positioned adjacent an internal ink chamber 40. According to the modification, the piezo-electric elements 36,38 are electrically conducting connected to the terminals 6,8 of the high voltage source 10, respectively. When a high voltage difference is maintained between the piezo-electric elements 36,38, these act as the first and second electrodes 2.*i*, 4.*j*.

The device of FIG. 6 may be operated as follows. Instead of an ink, a gas flow is fed into the print head 35, as indicated with arrow G. When the surface 20 of the substrate 14 is to be selectively treated with a plasma, the location where the surface 20 is to be treated is determined. The nozzle 37.*n* and the associated first electrode 2.*i* and second electrode 4.*j* closest to the determined location on the surface are selected. In this example, first electrode 2.3 and second electrode 4.3 are selected.

Initially all first electrodes 2.*i* and all second electrodes 4.*j* may be disconnected from the high voltage source 10, so that no plasma discharge is generated. The selected first electrode 2.3 and the selected second electrode 4.3 are connected to the high voltage source 10 via switches 24.5 and 24.6, respectively. Then, in the region between the electrodes, the plasma 22 will be generated. Due to the velocity of the gas flow, the plasma 22 will be ejected from the nozzle 37.3 towards the surface 20 of the substrate. It will be appreciated that the modified inkjet head 35 may be scanned along the surface 20.

It will be appreciated that other conventional inkjet heads may also be converted for forming the device 1 according to the invention. It is for instance possible that the first electrode is formed by a piezo-electric element of the print head while the second electrode is formed by an electrically conducting nozzle plate surrounding the nozzle. It is also possible that an alternative electrically conducting structure within the conventional inkjet print head, such as an electrical heating resistor forms an electrode for generating the plasma.

It will de appreciated that the device for generating a plasma discharge, suitable for maskless direct patterning of a substrate as described above may be used for treating the surface of the substrate using the plasma, e.g. for etching the surface, deposition of matter onto the surface, or changing a surface property such as wettability. The latter may e.g. be used for printing purposes, by locally modifying the wettability of the surface with respect to the printing medium (e.g. ink or solder).

It will be appreciated that the device for generating a plasma discharge, suitable for maskless direct patterning of a substrate as described with respect to FIGS. 1-6 above may be used for manufacturing a meso-scale electronics device, such as an (O)LED device, an RFID tag, or a solar-cell device); a meso-scale three dimensional structure, such as a MEMS device, a micro-lens or a multi-focus lens; a lab-on-chip; a biochip; a printable plastics object or an offset printing plate from a substrate.

It will be appreciated that the plasma 22 may be generated under atmospheric conditions. Alternatively, the plasma may be generated at reduced or elevated pressure. The plasma may e.g. be formed in air. The plasma may also be formed in a gas comprising argon, oxygen, ammonia, nitrogen, helium or a mixture thereof. Also precursors, e.g. vapourized, may be added to the gas (mixture), e.g. organosilicon compounds, such as hexamethyldisiloxane (HMDSO) or (3-aminopropyl) trimethoxysilane (APTMS), heptylamine, water ($H_2O$), or methanol ($CH_3OH$).

In the foregoing specification, the invention has been described with reference to specific examples of embodiments of the invention. It will, however, be evident that various modifications and changes may be made therein without departing from the broader spirit and scope of the invention as set forth in the appended claims.

In the examples the electrodes in the housing 16 are needle-like. However, other shapes are also possible.

In the example of FIG. 1 the second electrode 4 is plate-shaped. It will be appreciated that other designs are possible. It is for instance possible that second electrode comprises a plurality of needle-like electrodes, each of which may be positioned opposite a needle-like first electrode, with the substrate between the first and second needle-like electrode.

In the example, the needle-like electrodes may be simple metal rods or needles. It will be appreciated that nano-structured or micro-structured electrodes may be used. The nano-/micro-structured electrodes may enhance the field emission, can be used to confine the plasma in a small area hereby increase the resolution of the device, and influence the characteristics and inception voltage of the plasma. These nano-/micro-structured electrodes may e.g. be produced by laser deposition or ablation of a needle tip, dedicated cristal growth at the needle tip or by using carbon nanotubes at the needle tip.

Although FIGS. 1, 2, 3, 5 and 6 shows a one-dimensional array of electrodes, a two-dimensional array of electrodes may be used.

It will be appreciated that the electrodes comprising the electrical insulation 28.*k* as shown in FIG. 5, may also be used in the other embodiments.

In the examples of FIGS. 1-5, the electrodes in the housing were shown as parallel electrodes, moving in parallel. However, the electrodes do not need to be parallel. The electrodes may for instance be mounted in the housing 16 at an angle with respect to each other. It will be appreciated that when a first and a second electrode are mounted in the housing so as to converge when moved from the retracted to the extended position, the distance between the discharge portion of said electrodes may be reduced highly efficiently. Similar results may be obtained when the electrodes are moved along a curved or angled path in the housing.

In the examples, the discharge portion is located near the tip of the electrode. It is also possible that the discharge portion of the electrode is positioned otherwise, e.g. near a curve of a curved electrode.

In the examples of FIGS. 3 and 5 the electrodes are selectively connected to the high voltage source through respective switches. It will be appreciated that also alternative switching means are possible, such as electronic switching means, selective amplification etc. It is also possible that the switches switch between a high voltage difference, capable of supporting plasma discharge, and a low voltage difference, capable of extinguishing the plasma discharge. It will be appreciated that it is also possible that the high voltage source is arranged to in a first mode selectively generate the high voltage difference to support the plasma discharge, and in a second mode generate a decreased voltage difference or zero voltage difference to prevent plasma discharge, e.g. by selectively increasing or decreasing a voltage difference between certain electrodes.

However, other modifications, variations and alternatives are also possible. The specifications, drawings and examples are, accordingly, to be regarded in an illustrative rather than in a restrictive sense.

In the claims, any reference signs placed between parentheses shall not be construed as limiting the claim. The word 'comprising' does not exclude the presence of other features or steps then those listed in a claim. Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to advantage.

What is claimed is:

1. A device for generating a plasma discharge for patterning a surface of a substrate, comprising a first electrode having a first discharge portion and a second electrode having a second discharge portion, a high voltage source for generating a high voltage difference between the first and the second electrode, and one or more position components for positioning the first electrode with respect to the substrate, wherein the one or more position components are arranged for selectively positioning the first electrode with respect to the second electrode in a first position in which a distance between the first discharge portion and the second discharge portion is small enough to support the plasma discharge at the high voltage difference, and in a second position in which the distance between the first discharge portion and the second discharge portion is large enough to prevent the plasma discharge at the high voltage difference, wherein the device comprises a plurality of first electrodes and one or more second electrodes, and wherein the one or more position components are arranged for individually positioning each first electrode with respect to the one or more second electrodes.

2. A device for generating a plasma discharge for patterning a surface of a substrate, comprising a first electrode having a first discharge portion and a second electrode having a second discharge portion, a high voltage source for generating a high voltage difference between the first and the second electrode, and one or more position components for positioning the first electrode with respect to the substrate, wherein the one or more position components are arranged for selectively positioning the first electrode with respect to the second electrode in a first position in which a distance between the first discharge portion and the second discharge portion is small enough to support the plasma discharge at the high voltage difference, and in a second position in which the distance between the first discharge portion and the second discharge portion is large enough to prevent the plasma discharge at the high voltage difference, wherein the device comprises a plurality of first electrodes and one or more second electrodes, and wherein the one or more position components are arranged for individually positioning each first electrode with respect to the remaining first electrodes.

3. A device for generating a plasma discharge for patterning the surface of a substrate, comprising a first electrode having a first discharge portion and a second electrode having a second discharge portion, a high voltage source for generating a high voltage difference between the first and the second electrode, and one or more position components for positioning the first electrode with respect to the substrate, wherein the one or more position components are further arranged for positioning the second electrode in synchronism with the first electrode, wherein the high voltage source is arranged to in a first mode selectively generate the high voltage difference to support the plasma discharge, and in a second mode generate a decreased voltage difference or zero voltage difference to prevent plasma discharge.

4. The device according to claim 3, wherein the first and second electrodes are coupled mechanically.

5. The device according to claim 3, comprising a plurality of first electrodes and a plurality of second electrodes, wherein the high voltage source is arranged for selectively applying the high voltage between at least one first electrode and at least one second electrode.

6. A device for generating a plasma discharge for patterning a surface of a substrate, comprising a plurality of first electrodes having a first discharge portion and one or more second electrodes having a second discharge portion, a high voltage source for generating a high voltage difference between the first electrodes and the one or more second electrodes, and one or more position components for positioning the first electrodes with respect to the substrate, wherein the one or more position components are arranged for selectively positioning the first electrodes with respect to the one or more second electrodes in a first position in which a distance between the first discharge portion and the second discharge portion is small enough to support the plasma discharge at the high voltage difference, and in a second position in which the distance between the first discharge portion and the second discharge portion is large enough to prevent the plasma discharge at the high voltage difference, wherein the one or more position components are arranged for individually positioning each first electrode with respect to the one or more second electrodes.

7. The device according to claim 6, wherein the one or more position components are arranged for moving the first electrodes in a direction towards and away from the one or more second electrodes.

8. The device according to claim 6, wherein the second electrode is designed as a drum on the outer surface of which a sheet-shaped substrate can be placed in between the drum and the first electrodes, while the one or more position components are arranged for moving the first electrodes in a direction normal to the outer surface.

9. The device according to claim 6, wherein the one or more position components are further arranged for positioning the first electrodes along the surface of the substrate.

10. The device according to claim 6, further comprising a housing, wherein the first electrodes are at least partially surrounded by the housing, and the first electrodes are movable with respect to the housing.

11. The device according to claim 6, wherein the high voltage source is arranged for adjusting the high voltage difference between the first and the second electrode.

12. The device according to claim 6, wherein the first electrodes are formed by movable pens of a print head of a matrix printer, electrically conducting connected to the high voltage source.

13. A method for patterning a surface of a substrate using a plasma discharge, comprising:

providing a device according to claim 6, creating the plasma discharge by generating a high voltage difference between the first discharge portion and the second discharge portion, and moving the first electrode and second electrode in synchronism along the surface of the substrate.

14. A method of manufacturing a device for generating a plasma discharge according to claim 6, comprising:

providing a conventional matrix printer;

providing a high voltage source for generating a high voltage difference;

electrically conducting connecting at least one printing pen of the print head of the matrix printer with the high voltage source.

15. A method of manufacturing a device for generating a plasma discharge according to claim 6, comprising:

providing a conventional inkjet printer;

providing a high voltage source for generating a high voltage difference;

electrically conducting connecting at least one electrical conducting structure of the print head of the inkjet printer with the high voltage source.

16. The device according to claim 6, wherein the first electrodes and/or the one or more second electrodes are nanostructured or micro-structured.

17. The device according to claim 16, wherein the nanostructure or micro-structure is generated by laser deposition or ablation at the discharge portion, dedicated cristal growth at the discharge portion or by providing carbon nanotubes at the discharge portion.

18. A method for manufacturing a meso-scale electronics device, a meso-scale three dimensional structure, a lab-on-chip, a biochip, a printable plastics object or an offset printing plate from a substrate, comprising treating the substrate with a device for generating a plasma discharge according to claim 6.

19. The method according to claim 18, wherein the meso-scale electronics device is selected from the group consisting of an (O)LED device, an RFID tag and a solar-cell device.

20. The method according to claim 18, wherein the meso-scale three dimensional structure is selected from the group consisting of a MEMS device, a micro-lens and a multi-focus lens.

21. A method for patterning a surface of a substrate using a plasma discharge, comprising:

providing a device according to claim 6, generating a high voltage difference between the first and the second electrode, and selectively generating the plasma discharge by positioning the first electrode with respect to the second electrode in the first position, and selectively extinguishing the plasma discharge by positioning the first electrode with respect to the second electrode in the second position.

22. The method according to claim 21, comprising moving the first electrode in a direction towards the second electrode when moving the first electrode into the first position and moving the first electrode in a direction away from the second electrode when moving the first electrode into the second position.

23. The method according to claim 21, further comprising scanning the first electrode along the surface of the substrate.

24. The method according to claim 21, comprising simultaneously positioning a plurality of first electrodes with respect to the substrate and individually positioning each first electrode with respect to the second electrode.

25. The method according to claim 21, further comprising selectively etching the surface using the plasma discharge, selectively depositing a material onto the surface using the plasma discharge, and/or selectively changing a property of the surface using the plasma discharge.

26. The method according to claim 25, wherein said selective changing of a property of the surface comprises changing the property from being hydrophobic to being hydrophilic.

27. A device for generating a plasma discharge for patterning a surface of a substrate, comprising a plurality of first electrodes having a first discharge portion and one or more second electrodes having a second discharge portion, a high voltage source for generating a high voltage difference between the firsts electrodes and the one or more second electrodes, and one or more position components for positioning the first electrodes with respect to the substrate, wherein the one or more position components are arranged for selectively positioning the first electrodes with respect to the one or more second electrodes in a first position in which a distance between the first discharge portion and the second discharge portion is small enough to support the plasma discharge at the high voltage difference, and in a second position in which the distance between the first discharge portion and the second discharge portion is large enough to prevent the plasma discharge at the high voltage difference, wherein the one or more position components are arranged for individually positioning each first electrode with respect to the remaining first electrodes.

* * * * *

UNITED STATES PATENT AND TRADEMARK OFFICE

CERTIFICATE OF CORRECTION

PATENT NO. : 8,702,902 B2
APPLICATION NO. : 13/059909
DATED : April 22, 2014
INVENTOR(S) : Blom et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 407 days.

Signed and Sealed this
Twenty-ninth Day of September, 2015

Michelle K. Lee

Michelle K. Lee
*Director of the United States Patent and Trademark Office*